US007493074B2

(12) United States Patent
Komuro

(10) Patent No.: US 7,493,074 B2
(45) Date of Patent: Feb. 17, 2009

(54) FIXING DEVICE, SHEET MEMBER, AND IMAGE FORMING APPARATUS

(75) Inventor: Hitoshi Komuro, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 331 days.

(21) Appl. No.: 11/189,735

(22) Filed: Jul. 27, 2005

(65) Prior Publication Data

US 2006/0216077 A1 Sep. 28, 2006

(30) Foreign Application Priority Data

Mar. 23, 2005 (JP) ..... 2005-084017

(51) Int. Cl.
*G03G 15/20* (2006.01)

(52) U.S. Cl. ..... 399/328; 399/329

(58) Field of Classification Search ..... 399/107, 399/122, 320, 328, 329, 330, 332, 333, 334; 219/619; 492/56
See application file for complete search history.

(56) References Cited

U.S. PATENT DOCUMENTS 5,402,220 A * 3/1995 Tanaka et al. ..... 399/68
6,002,910 A * 12/1999 Eddy et al. ..... 399/329
7,321,746 B2 * 1/2008 Sakakibara et al. ..... 399/333
2004/0157717 A1 * 8/2004 Oh et al. ..... 492/56

FOREIGN PATENT DOCUMENTS

| | | |
|---|---|---|
| JP | A-08-087191 | 4/1996 |
| JP | A-08-286555 | 11/1996 |
| JP | A-09-034291 | 2/1997 |
| JP | A-2004-053674 | 2/2004 |

* cited by examiner

*Primary Examiner*—Hoan H Tran
(74) *Attorney, Agent, or Firm*—Oliff & Berridge, PLC

(57) ABSTRACT

The present invention provides a fixing device that has a planar member including a heat conduction layer. The heat conduction layer has a predetermined thickness and relatively pressed against a rotary member being rotated so that the device fixes an unfixed toner image born by a recording sheet onto the recording sheet by causing the sheet bearing the unfixed toner image to pass between the planar member and the rotary member and applying heat and pressure to the unfixed toner image. The device includes a heater that applies heat to the unfixed toner image born by the sheet passing between the planar member and rotary member. The heat conduction layer includes a heat conduction anisotropic material whose heat conduction coefficient showing the degree of easiness of heat conduction in a surface direction in which the heat conduction layer extends is larger than that in a thickness direction.

16 Claims, 8 Drawing Sheets

FIXING DEVICE, SHEET MEMBER, AND IMAGE FORMING APPARATUS

BACKGROUND OF THE INVENTION

1. Field of the Invention

The present invention relates to a fixing device having a planar member, which is relatively pressed against a rotary member being rotated and includes a heat conduction layer having a predetermined thickness and causing a recording sheet that bears an unfixed toner image to pass between the planar member and the rotary member to thereby apply heat and pressure to the unfixed toner image so that the unfixed toner image is fixed onto the recording sheet, to a sheet member disposed to the fixing device, and to an image forming apparatus including the fixing device.

2. Description of the Related Art

Among image forming apparatuses such as a copy machine, a printer, a facsimile, and the like that employ an electrophotographic system, there is known an image forming apparatus including a fixing device that fixes an unfixed toner image transferred onto a recording sheet such as a paper sheet and the like onto the recording sheet. As a type of the fixing device, there is known a fixing device that forms a nip region between the peripheral surfaces of a pair of rotatable rotary members which are caused to come into contact with each other, causes a recording sheet that bears an unfixed toner image to pass through the nip region to thereby apply heat and pressure to the unfixed toner image so that it is fixed onto the recording sheet. There is known, for example, a so-called roll-roll type fixing device using a heat roll having a heat source disposed therein and a pressure roll having an elastic layer formed therearound as a pair of rotatable rotary members. However, in the roll-roll type fixing device, the heat roll is also provided with a somewhat thick elastic layer formed therearound to form a nip region longer than a predetermined length. A problem arises from the above arrangement in that the heat capacity of the heat roll is increased, and thus a time (herein after, referred to as "warm up time") necessary to heat the heat roll from a room temperature to a fixing possible temperature is increased. To cope with the above problem, there is proposed a so-called roll-belt type fixing device using an endless belt in place of the pressure roll (for example, Japanese Patent Application Laid-Open No. 9-34291).

FIG. 1 is a schematic arrangement view of an example of a conventional roll-belt type fixing device.

The fixing device 300 shown in FIG. 1 has a main portion including a heat roll 310 having a heat source contained therein, an endless fixing belt 320 stretched around three support rolls 321, 322, and 323, and a pressure application member 330 that is abutted against the inner peripheral surface of the fixing belt 320 and presses the fixing belt 320 along the surface of the heat roll 310.

The heat roll 310 has a cylindrical core 311 disposed therein and is driven in rotation by a not shown motor in the direction of an arrow in the figure. The core 311 has an elastic layer 312 formed on the surface thereof, and the surface of the elastic layer 312 is covered with a mold release layer 313. That is, the surface of the heat roll 310 is formed of the mold release layer 313. The core 311 has a halogen lamp 314 as a heat source disposed therein. Further a mold releaser application unit 340 is disposed in the vicinity of the heat roll 310 to apply mold release oil as a mold releaser. In the mold releaser application unit 340, the mold releaser 342 dropped from an oil pipe 341 is supplied to a pick-up roll 344 through an oil wick 343, and the mold releaser 342 excessively supplied to the pick-up roll 344 is scraped off by a metering blade 345 and returned from an oil pan 346 to a not shown oil tank. Further, the mold releaser 342 supplied to the surface of the pick-up roll 344 is applied onto the surface of the heat roll 310 through a donor roll 347. Note that the materials deposited on the surface of the pick-up roll 344 are eliminated with a cleaning blade 348. Further, an external heat roll 350 is disposed on the surface of the heat roll 310 to heat the surface of the heat roll 310 at a predetermined timing in contact with the surface. Further, a temperature sensor 380 is disposed on the surface of the heat roll 310 to control the surface temperature of the heat roll 310.

The fixing belt 320 is circulated by the rotation of the heat roll 310 with the surface thereof pressed against the heat roll 310. One of the three support rolls 321, 322, and 323, that is, the support roll 321, around which the fixing belt 320 is stretched, has a heater lamp 3211 disposed therein.

The pressure application member 330 is composed of a metal base plate 331 and an elastic layer 334 disposed on the surface of the base plate 331, and the elastic layer 334 is composed of a silicon rubber foamed member and laminated on a metal support plate 333 through a shim 332. Further, the entire peripheral surface of the pressure application member 330 is covered with a low friction sheet 335 as a sheet-shaped member. The low friction sheet 335 is provided to reduce the sliding resistance between the pressure application member 330 and the fixing belt 320. The low friction sheet 335 is composed of a material having a heat resistant property and a wear resistant property and has large concavo/convex portions formed on the surface thereof. The pressure application member 330 is urged to the heat roll 310 by a not shown compression coil spring disposed to the base plate 331 side with press force of, for example, 50 kgf. The contact surface of the low friction sheet 335 in contact with the fixing belt 320 can be aligned with the surface of the heat roll 310 by disposing the elastic layer 334 to the pressure application member 330. That is, when the pressure application member 330 is pressed against the heat roll 310 with a load of a predetermined magnitude or more, the elastic layer 334 is deformed and the contact surface of the low friction sheet 335 is deformed along the outer peripheral surface of the heat roll 310. Accordingly, when the pressure application member 330 is pressed against the heat roll 310 by the not shown compression coil spring, the outer peripheral surface of the fixing belt 320 is caused to come into pressure contact with the surface of the heat roll 310 without intervals there between while the inner peripheral surface of the fixing belt 320 is supported by the pressure application member 330. The outer peripheral surface of the fixing belt 320 is pressed against the heat roll 310 by the pressure application member 330 and the support roll 323 disposed in the vicinity of the pressure application member 330, thereby a nip region N is formed.

Silicon oil is applied to the inner peripheral surface of the fixing belt 320 by a lubricant application member 360 composed of felt and the like, thereby the sliding resistance between the fixing belt 320 and the low friction sheet 335 can be reduced. When the silicon oil is applied, the fixing belt 320 can be caused to travel by the rotation of the heat roll 310 while sliding on the low friction sheet 335 at a speed approximately the same as the rotational speed of the heat roll 310.

In FIG. 1, a toner image T is transferred onto a sheet P by a not shown transfer unit on the left side of the figure, and the sheet P that bears the unfixed toner image T is transported to the nip region N of the fixing device 300 shown in FIG. 1. When the sheet P enters the nip region N and passes therethrough, the unfixed toner image T is heated and pressed, thereby the unfixed toner image T is fixed onto the sheet P.

In the roll-belt type fixing device 300 shown in FIG. 1, since the portion of the fixing belt 320 in pressure contact with the peripheral surface of the heat roll 310 is formed in the shape along the peripheral surface of the heat roll 310, the nip region N longer than a predetermined length is formed more easier than in the roll-roll type fixing device. Accordingly, the heat roll 310 shown in FIG. 1 is formed thinner than that of the heat roll disposed to the roll-roll type fixing device, thereby the warm-up time can be reduced.

Incidentally, sheets having plural sizes are fed to the nip region N of the fixing device. As shown in FIG. 1, in the fixing device, in which the thickness of the elastic layer 312 of the heat roll 310 is made thin to reduce the heat capacity of the heat roll 310, when a sheet having a width smaller than a maximum sheet passing width is passed, that is, when an A4 sheet is longitudinally passed through a fixing device, through which an A3 sheet, for example, can be passed, or when a B4 sheet is passed therethrough, both the end portions of the nip region N in the width direction thereof (direction perpendicular to a sheet surface in FIG. 1) are made to regions through which no sheet is passed (herein after, referred to as "non-sheet-pass regions). Since the heat of the non-sheet-pass regions is not absorbed by a sheet, the temperature of the non-sheet-pass regions is significantly increased. When the temperature of the non-sheet-pass regions is significantly increased, a problem arises in that the fixing belt is deteriorated by heat or peripheral components are damaged. Further, the low friction sheet 335 shown in FIG. 1 is deteriorated by heat, and the silicon oil applied to the front surface of the low friction sheet 335 is also deteriorated, thereby the sliding resistance of the fixing belt is increased, the load torque of the fixing device is increased, and sheet get wrinkled and images are offset by a sheet transport failure. In addition to the above drawbacks, nip pressure is distributed in a state different from an ordinary state due to the uneven amount of thermal expansion of the pressure application member 330, from which a problem arises in that sheets get wrinkled and are curled, and images are unevenly fixed on sheets. Further, when an A3 sheet is passed in the state that the temperature of the non-sheet-pass regions is significantly increased, the A3 sheet comes into contact with the non-sheet-pass regions whose temperature is significantly increased and is excessively heated, thereby toner is hot offset or the amount of curl of the sheet is increased.

Conventionally, various approaches are contemplated to cope with these problems, and some of them can be applied to the roll-belt type fixing device as shown in FIG. 1.

For example, as one of the approaches, it is contemplated to dispose plural heat sources, which are classified according to sheet sizes, in the heat roll to heat the nip region and to switch power supplied to the heat sources according to the size of a sheet to be passed.

In this case, however, problems arise in that it is difficult to dispose the plural heat sources in the heat roll because the diameter of the heat roll is recently reduced to satisfy the requirement for the reduction in size of the fixing device, that a cost is increased by the increase of the number of the heat sources, and that a control becomes complex because the plural heat sources must be switched. In view of the these problems, it is difficult to dispose heat sources corresponding to all the sheet sizes, and actually, two or three heat sources are disposed, which is insufficient to overcome the outstanding temperature increase in the non-sheet-pass regions.

Further, as other approaches, although it is also contemplated to suppress the increase of temperature of the non-sheet-pass regions by relatively separating the heat roll from the fixing belt or reducing the passing speed of sheets, these approaches reduce the number of sheets that can be fixed per unit time, and the speed-up of the fixing device is prevented.

Further, there have been proposed approaches for solving these problems mechanically in the conventional roll-roll type fixing device (refer to, for example, Japanese Patent Application Laid-Open Nos. 8-87191, 2004-53674, and 8-286555. Japanese Patent Application Laid-Open No. 8-87191 proposes a technique for reducing the outstanding temperature increase of non-sheet-pass regions by causing a high heat conductive member to come into contact with the surface of a heat roll from the outside. However, this proposal is not preferable because the surface of the heat roll is likely to be scratched by the contact thereof with the high heat conductive member. To cope with the above problem, Japanese Patent Application Laid-Open No. 2004-53674 proposes to dispose a high heat conductive member so that it is free to come into contact with and to separate from the surface of a fixing member. In this proposal, however, since a mechanism is additionally necessary to dispose the high heat conductive member so that it is free to come into contact and to separate from the fixing member, thereby the cost and the size of a fixing device are increased. Although Japanese Patent Application Laid-Open No. 8-286555 proposes a technique for reducing the increase of temperature of non-sheet-pass regions by disposing a heat pipe in the metal core of a pressure roll disposed in confrontation with a heat roll, a cost is increased by disposing the heat pipe. Further, since the diameter and the wall thickness of recent pressure rolls are reduced, it is difficult to assemble the heat pipe to the thick portion of the core from a view point of space. Furthermore, in the fixing device as shown in FIG. 1 in which the pressure roll is replaced with the fixing belt, it is primarily impossible to dispose the heat pipe and the like to the fixing belt. Accordingly, when the heat pipe is to be disposed, it must be disposed in a heat roll. In this arrangement, however, the heat roll cannot sufficiently exhibit its function, and the problems cannot be solved.

SUMMARY OF THE INVENTION

The present invention has been made in view of the above circumstances and provides a fixing device that can suppress the outstanding temperature increase of non-sheet-pass regions at a low cost without preventing the reduction in size and the speed-up of the device, a sheet member disposed to the fixing device, and an image forming apparatus having the fixing device.

A fixing device according to the present invention has a planar member including a heat conduction layer, the heat conduction layer having a predetermined thickness and relatively pressed against a rotary member being rotated so that the fixing device fixes an unfixed toner image born by a recording sheet onto the recording sheet by causing the recording sheet that bears the unfixed toner image to pass between the planar member and the rotary member and applying heat and pressure to the unfixed toner image, the fixing device including:

a heater that applies heat to the unfixed toner image born by the recording sheet passing between the planar member and rotary member; and a support member disposed to the inner peripheral surface of the planar member to support the planar member from the inner peripheral surface, wherein the heat conduction layer includes a heat conduction anisotropic material whose heat conduction coefficient showing the degree of easiness of heat conduction in a surface direction in which the heat conduction layer extends is larger than a heat conduction coefficient thereof showing the degree of easiness of heat conduction in a thickness direction.

According to the fixing device of the present invention, since the heat conduction layer is likely to conduct heat relatively in the surface direction, the heat received between the planar member and the rotary member is likely to spread in the surface direction. Accordingly, there can be suppressed an outstanding increase of temperature of both the ends of the nip region, which are not in contact with the recording sheet nipped in the nip region, in the width direction perpendicular to the circulating direction of the endless belt (non-sheet-pass regions). Further, since the sheet member suppresses the outstanding increase of temperature in the non-sheet-pass regions by a material-based approach, cost up can be also suppressed without preventing the reduction in size and the speed-up of the device.

A sheet member according to the present invention is disposed to a fixing device, the fixing device having a rotary member being rotated, an endless belt whose outer peripheral surface is relatively pressed against the rotary member and forms a nip region between the outer peripheral surface and the rotary member to nip a recording sheet in the nip region, a heater that applies heat to an unfixed toner image born by the recording sheet pinched in the nip region, and a support member disposed to the inner peripheral surface of the endless belt to support the outer peripheral surface of the endless belt from the inner peripheral surface and to apply relative press force to the nip region, and the sheet member having friction resistance smaller than that of the support member with the front surface of the sheet member in contact with the inner peripheral surface of the endless belt and the back surface thereof in contact with the support member, the sheet member including:

a heat conduction layer that includes a heat conduction anisotropic material whose heat conduction coefficient showing the degree of easiness of heat conduction in a surface direction in which the heat conduction layer extends is larger than a heat conduction coefficient thereof showing the degree of easiness of heat conduction in a thickness direction.

According to the sheet member of the present invention, since the heat conduction layer is likely to conduct heat in the surface direction due to the material thereof, the outstanding increase of temperature in the non-sheet-pass regions can be suppressed at a low cost without preventing the reduction in size and the speed-up of the device.

An image forming apparatus according to the present invention forms an image on a recording sheet by transferring a toner image formed on a toner image bearing member on which a toner image is formed and fixes an unfixed toner image onto the recording sheet, the image forming apparatus including:

a fixing device having a planar member that includes a heat conduction layer, the heat conduction layer having a predetermined thickness and relatively pressed against a rotary member being rotated to fix the unfixed toner image born by a recording sheet thereon by causing the recording sheet that bears the unfixed toner image to pass between the planar member and the rotary member and applying heat and pressure to the unfixed toner image, wherein the fixing device includes a heater that applies heat to the unfixed toner image born by the recording sheet passing between the planar member and rotary member, wherein the heat conduction layer includes a heat conduction anisotropic material whose heat conduction coefficient showing the degree of easiness of heat conduction in a surface direction in which the heat conduction layer extends is larger than a heat conduction coefficient thereof showing the degree of easiness of heat conduction in a thickness direction.

According to the image forming apparatus of the present invention, since the heat conduction layer of the planar member is likely to conduct heat in the surface due to the material thereof, the outstanding increase of temperature in the non-sheet-pass regions can be suppressed at a low cost without preventing the reduction in size and the speed-up of the device.

BRIEF DESCRIPTION OF THE DRAWINGS

A preferred embodiment of the present invention will be described below in detail based on the following figures, wherein.

DETAILED DESCRIPTION OF THE INVENTION

An embodiment of the present invention will be described below with reference to the drawings.

Figure 2:
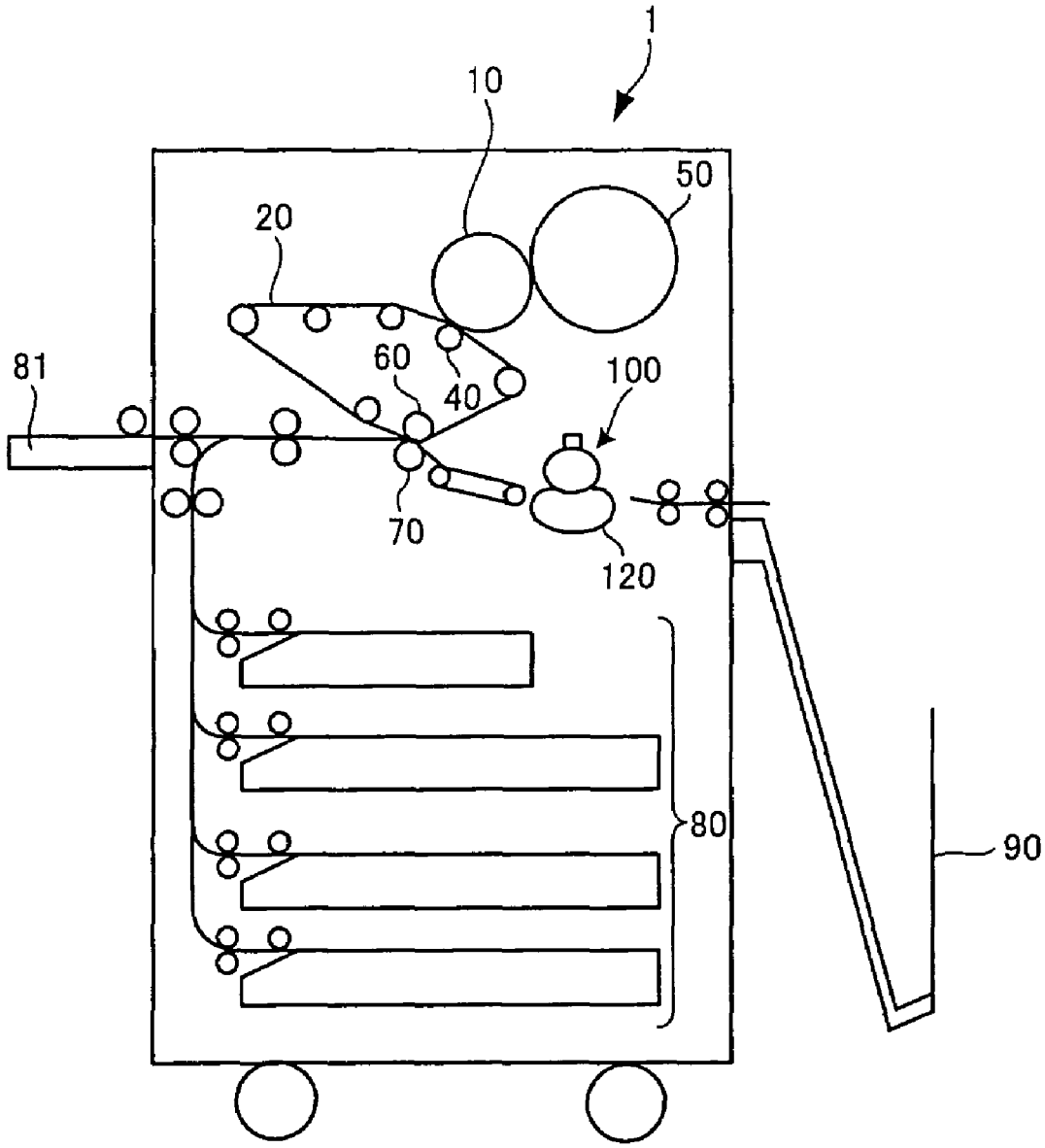
FIG. 2 is a view showing the schematic arrangement of a full color image forming apparatus corresponding to an embodiment of an image forming apparatus of the present invention.

FIG. 2 is a view showing the schematic arrangement of a full color image forming apparatus corresponding to an embodiment of an image forming apparatus of the present invention.

The image forming apparatus 1 shown in FIG. 2 has a roll-belt type fixing device 100 assembled thereto, the fixing device 100 corresponding to an embodiment of a fixing device of the present invention. The image forming apparatus 1 also includes a photoreceptor drum 10 and an intermediate transfer belt 20. The photoreceptor drum 10 rotates clockwise. The intermediate transfer belt 20 is stretched by plural support rolls and disposed to come into contact with the surface of the photoreceptor drum 10. In the image forming apparatus 1, a primary transfer roll 40 is disposed at a position confronting the photoreceptor drum 10 across the intermediate transfer belt 20. The portion at which the photoreceptor drum 10 is in contact with the intermediate transfer belt 20 acts as a primary transfer position.

A development rotary 50 is disposed on the peripheral surface of the photoreceptor drum 10 upstream of the primary transfer position. The development rotary 50 has development units (not shown) disposed thereto, and the development unit accommodates color toner of black (BK), yellow (Y), magenta (M), and cyan (C). Further, a charge unit, an optical write unit, a cleaning unit, and a discharge unit are disposed around the peripheral surface of the photoreceptor drum 10, although they are not shown.

A bias roll 60 as a secondary transfer member is disposed on the peripheral surface of intermediate transfer belt 20 downstream of the primary transfer position, and further a back-up roll 70 is disposed at a position confronting the bias roll 60 across the intermediate transfer belt 20. In the image forming apparatus 1, the position sandwiched between the bias roll 60 and the back-up roll 70 acts as a secondary transfer position, and sheets supplied from a sheet feed tray group 80, in which sheets having various sizes, for example, A3 size, B4 size, A4 size, B5 size, and the like are accommodated separately according to their sizes, sheets placed on a manual feed tray 81, and OHP sheets are fed to the secondary transfer position.

The image forming apparatus 1 shown in FIG. 2 will be explained in more detail while explaining an image forming method embodied in the image forming apparatus 1 shown in FIG. 2 using also FIG. 3 together with FIG. 2.

Figure 3:
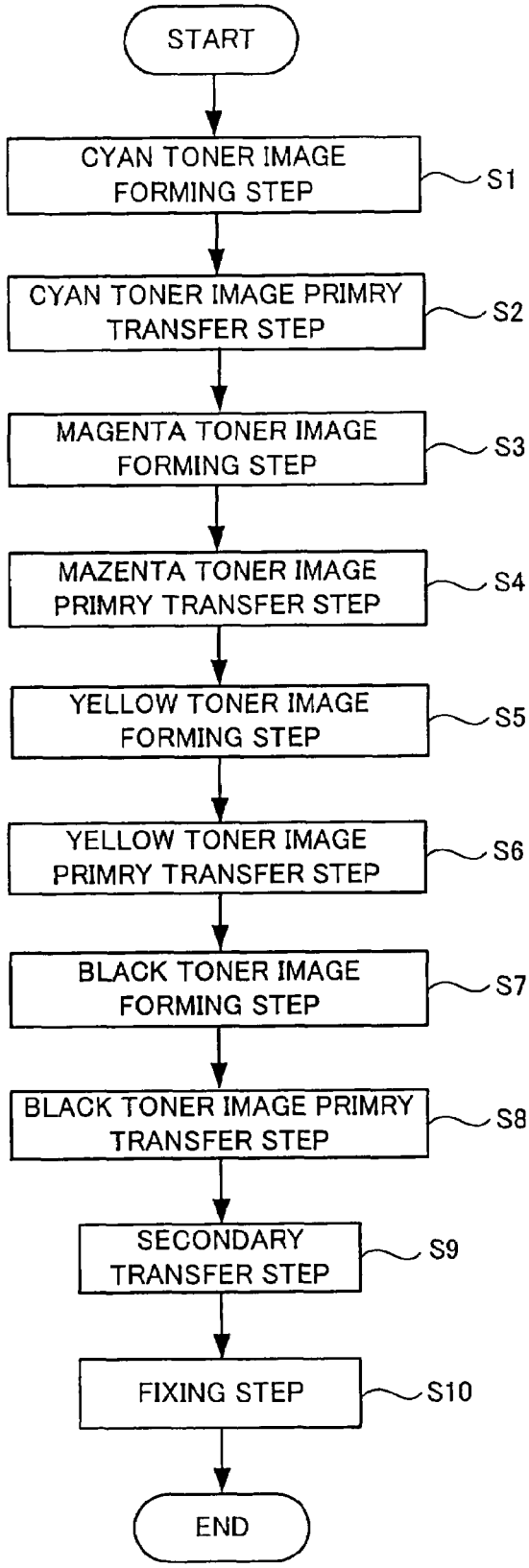
FIG. 3 is a flowchart showing the image forming method embodied in the image forming apparatus shown in FIG. 2.

FIG. 3 is a flowchart showing the image forming method embodied in the image forming apparatus shown in FIG. 2.

Image signals of four colors of yellow, magenta, cyan, and black are input to the image forming apparatus 1 shown in FIG. 2. When the image signals are input in the image forming apparatus 1, the surface of the image forming apparatus 1 is uniformly charged by the charge unit, and then an electrostatic latent image is formed on the surface of the photoreceptor drum 10 by irradiating a laser beam corresponding to the cyan image signal of the input image information from the optical write unit to the photoreceptor drum 10. The electrostatic latent image formed on the surface of the photoreceptor drum 10 is developed by the development unit disposed to the development rotary 50 and accommodating cyan toner, thereby a cyan toner image is formed on the surface of the photoreceptor drum 10 (cyan toner image forming step S1 shown in FIG. 3). Next, the cyan toner image on the photoreceptor drum 10 is primarily transferred onto the intermediate transfer belt 20 at the primary transfer position (cyan toner image primary transfer process S2 shown in FIG. 3). After the cyan toner image is primarily transferred onto the intermediate transfer belt 20, the toner remaining on the surface of the photoreceptor drum 10 is eliminated therefrom by the cleaning unit, and a remaining charge is eliminated by the discharge unit.

Subsequently, a magenta toner image is formed on the surface of the photoreceptor drum 10 likewise (magenta toner image forming process S3 shown in FIG. 3), and the magenta toner image is primarily transferred onto the intermediate transfer belt 20 at the primary transfer position so as to overlap the cyan toner image primarily transferred onto the intermediate transfer belt 20 previously (magenta toner image primary transfer process S4 shown in FIG. 3).

Thereafter, a yellow toner image and a black toner image are sequentially formed (yellow toner image forming process S5 and black toner image forming process S7 shown in FIG. 3) and primarily transferred onto the intermediate transfer belt 20 sequentially at the primary transfer position so as to overlap the toner images primarily transferred onto the intermediate transfer belt 20 previously (yellow toner image primary transfer process S6 and black toner image primary transfer process S8 each shown in FIG. 3). With this operation, the intermediate transfer belt 20 bears a single toner image on which cyan, magenta, yellow, and black toner overlaps in this sequence from the front surface of the belt 20.

Subsequently, the single overlapped toner image is secondarily transferred onto a sheet at the secondary transfer position sandwiched between the bias roll 60 and the back-up roll 70 (secondary transfer process S9 shown in FIG. 3). The toner image is transferred onto the sheet as described above, and the sheet on which the toner image is transferred is sent to the fixing device 100. In the fixing device 100, the sheet that bears the unfixed toner image is passed through a predetermined nip region and applied with heat and pressure, thereby the unfixed toner image is fixed onto the sheet (fixing process S10 shown in FIG. 3). The sheet having the toner image fixed thereon is output to an output tray 90 disposed to the image forming apparatus 1.

Figure 4:
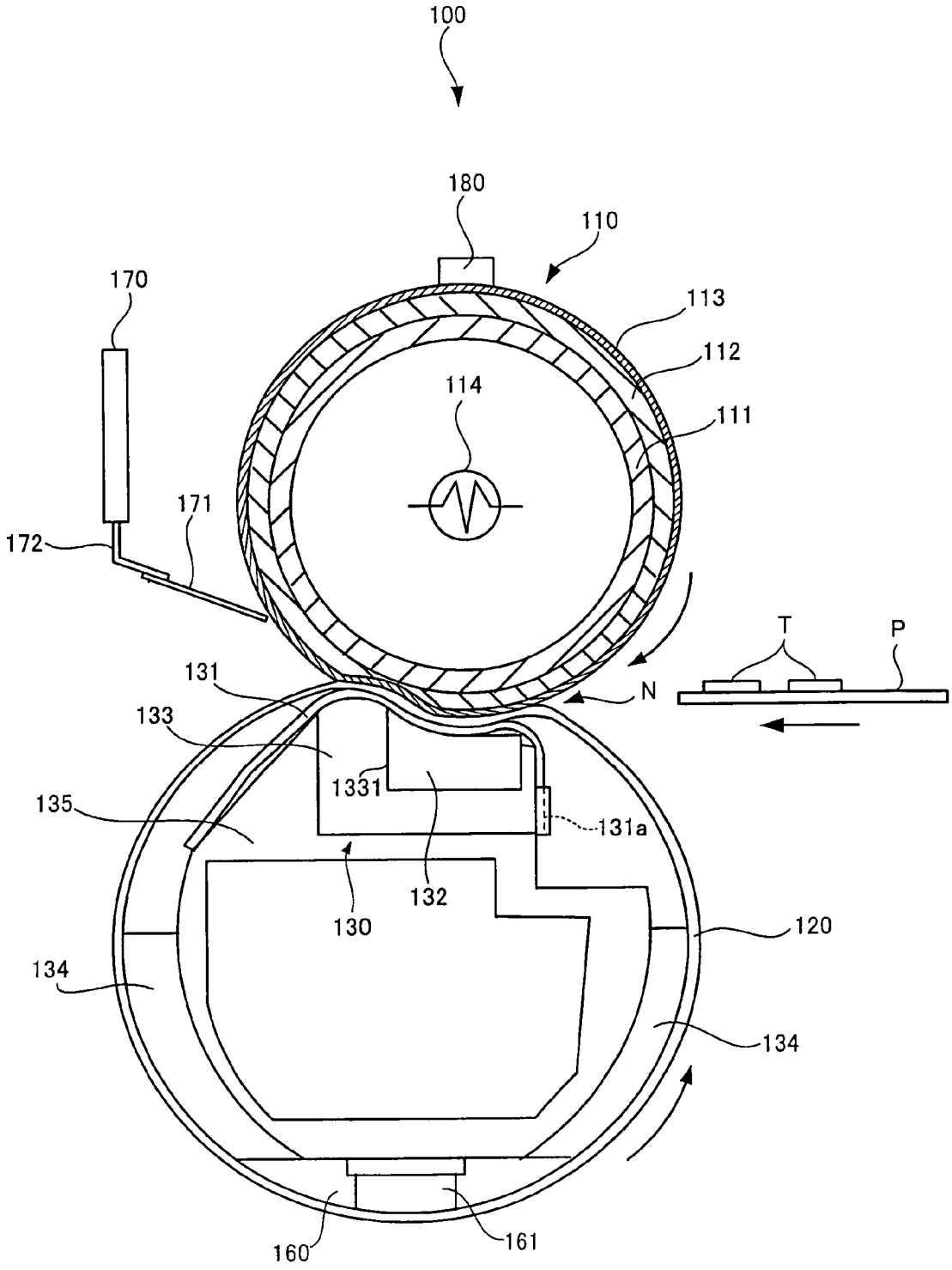
FIG. 4 is a view showing the schematic arrangement of a fixing device assembled to the image forming apparatus shown in FIG. 2.

FIG. 4 is a view showing the schematic arrangement of the fixing device assembled to the image forming apparatus shown in FIG. 2.

In FIG. 4, a recording sheet P which bears an unfixed toner image T is transported from right to left in the figure. The fixing device 100 shown in FIG. 4 employs a so-called free belt nip system in which a fixing belt is not stretched, different from the fixing device 300 shown in FIG. 1. The fixing device 100 shown in FIG. 4 has a main portion including a heat roll 110 having a heat source contained therein, an endless fixing belt 120, and a press member 130 that is abutted against the inner surface of the fixing belt 120 and presses the fixing belt 120 along the surface of the heat roll 110, and a nip region N, in which the sheet P that bears the unfixed toner image T is held, is formed between the heat roll 110 and the fixing belt 120.

The heat roll 110 has a cylindrical core 111 disposed therein and is driven in rotation by a not shown motor in the direction of an arrow B in the figure. The core 111 has an elastic layer 112 formed on the surface thereof, and the surface of the elastic layer 112 is covered with a mold release layer 113. That is, the surface of the heat roll 110 is formed of the mold release layer 113.

A cylindrical body composed of metal such as iron, aluminum, stainless steel, and the like having high heat conductivity can be used as the core 111. The outside diameter and the wall thickness of the core 111 may be determined to suitable sizes because the strength and the heat conductivity thereof are different depending on a material to be used. The core 111 of the embodiment is composed of an iron cylindrical body having a thickness of 0.5 mm and an outside diameter of 25 mm.

An elastic member having a high heat resistant property may be used as the material of the elastic layer 112. In particular, elastic materials such as rubber, elastomer, and the like having rubber hardness of approximately 25 to 40° (JIS-A hardness) may be used as the elastic layer 112, and specifically silicone rubber, fluorine rubber, and the like may be exemplified. The elastic layer 112 may have a thickness of approximately 0.3 to 1.0 mm although this is different depending on the rubber hardness of a material to be used. The elastic layer 112 of the embodiment is composed of silicone rubber having a thickness of approximately 0.6 mm and rubber hardness of approximately 30° (JIS-A hardness).

Particularly, fluorine resin may be as the mold release layer 113 in consideration of a mold releasing property and a wear resistant property. Although PFA (perfluoroalkylvinylether copolymer), PTFE (polytetrafluoroethylene), FEP (tetrafluoroethylene/hexafluoropropylene copolymer resin), and the like may be used as the fluorine resin, particularly PFA is more suitable among them from the viewpoint of a heat resistant property and workability. The mold release layer 113 may have a thickness of approximately 5 to 50 μm. When the thickness of the mold release layer 113 is less than 5 μm, it may be worn by the friction of the mold release layer 113 between the edge of the sheet P in the width direction thereof perpendicular to a transport direction and the heat roll 110, where as when the thickness exceeds 50 μm, the surface hardness of the mold release layer 113 is increased and defective image quality such as irregular glossiness and the like may appear, and thus both the thickness ranges are not preferable. Any conventionally known method may be used as the method of forming the mold release layer 113. There may be employed, for example, a method of covering the surface of the heat roll 110 with a tube, and a coating method of coating the heat roll 110 with a liquid member, in which resin intended to be formed is dissolved or dispersed in a suitable solvent, by dip coat, spray coat, roll coating, bar coat, spin coat, and the like. The mold release layer 113 of the embodiment is formed by covering the elastic layer 112 formed on the surface of the core 111 with 30 μm thick tubular PFA.

Figure 1:
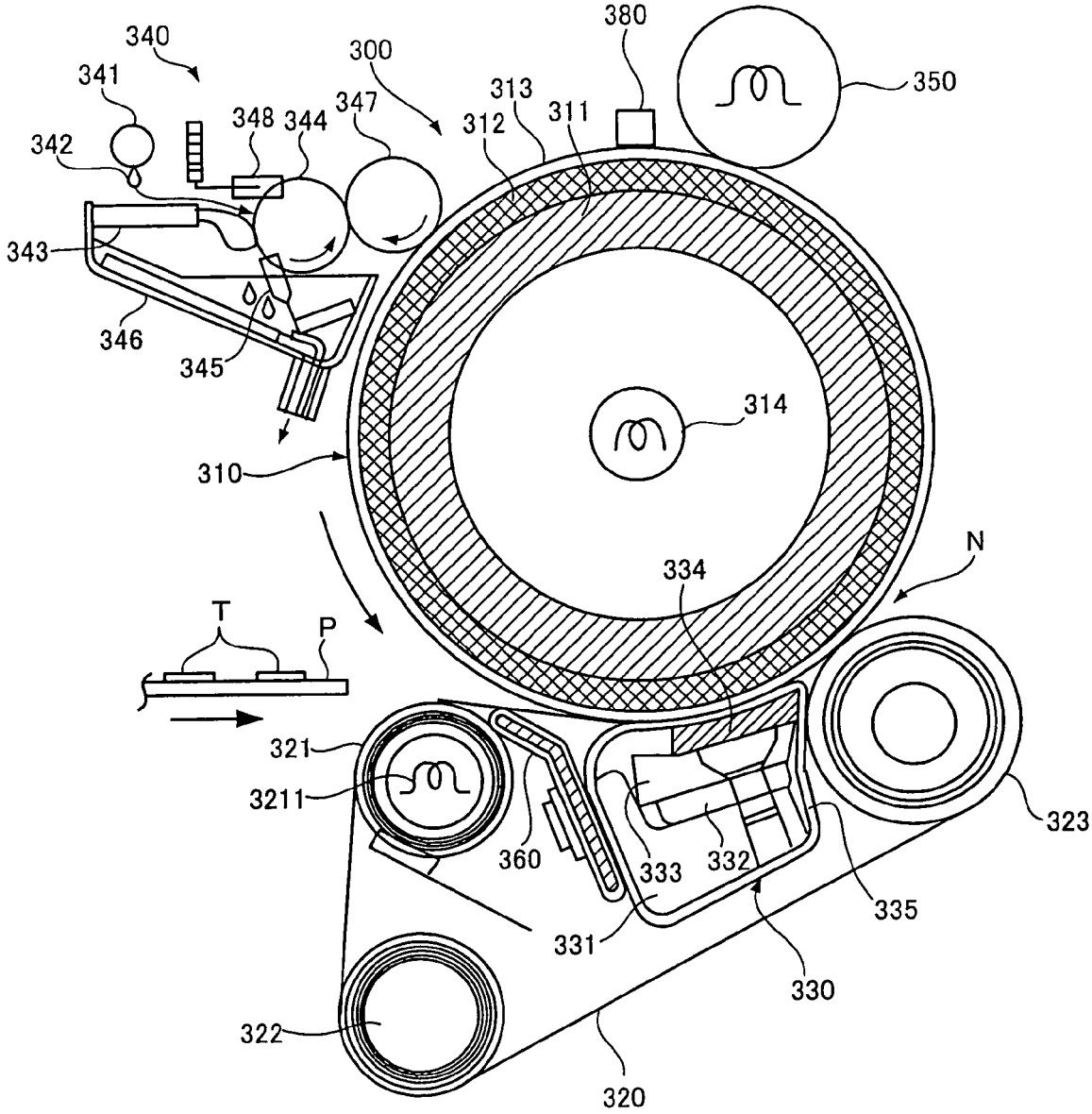
RELATED ART Fig. 1
FIG. 1 is a view showing the schematic arrangement of an example of a conventional roll-belt type fixing device.

The core 111 has a halogen lamp 114 as the heat source disposed therein. Note that the heat source may be any of the external heat roll 350 for externally heating the heat roll 310 as shown in FIG. 1 and the heater lamp 3211 contained in the support roll 321 to heat the fixing belt 320 as shown in FIG. 1 likewise as long as they heat the nip region N, that is, they apply heat to the unfixed toner image T born by the sheet P passing through the nip region N. Further, the fixing belt 120 itself may also act as the heat source by means of electromagnetic induction heating and the like. A temperature sensor 180 is disposed on the surface of the heat roll 110 and measures a surface temperature. Then, the halogen lamp 114 is feedback controlled by a not shown temperature controller in response to the measurement signal from the temperature sensor 180, thereby the surface temperature of the heat roll 110 is controlled approximately constant.

The fixing belt 120 is circulated by the rotation of the heat roll 110 with the surface thereof pressed against the heat roll 110. The fixing belt 120 comes into contact with the heat roll 110 so as to be wound therearound at a predetermined angle, and the nip region N is formed between the fixing belt 120 and the heat roll 110. The winding angle of the fixing belt 120 to the heat roll 110 may be set to approximately 15 to 45° to secure a wide (large) nip region, although it is different depending on the rotation speed of the heat roll 110. In the fixing belt 120 shown in FIG. 4, the shape and the size of the press member 130 is designed to set the winding angle to 27°. The fixing belt 120 has a laminated structure in which plural layers are laminated in the thickness direction thereof. Explanation will be made here using FIG. 5 departing from FIG. 4 once.

Figure 5:
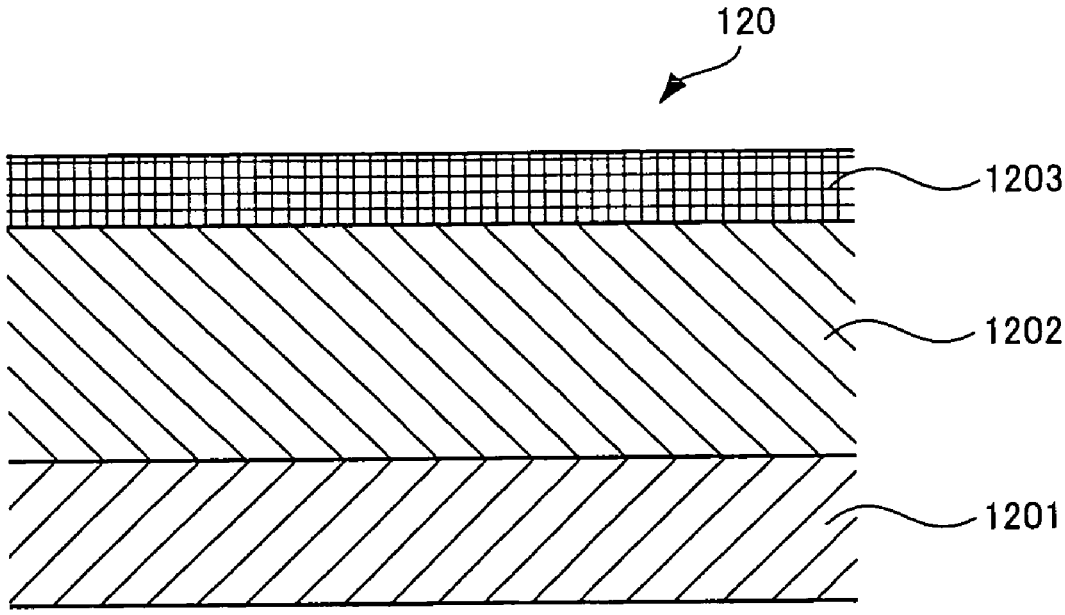
FIG. 5 is a view schematically showing the section of a fixing belt shown in FIG. 4.

FIG. 5 is a view schematically showing the section of the fixing belt shown in FIG. 4.

The fixing belt 120 shown in FIG. 5 is composed of a base layer 1201, a heat resistant elastic layer 1202, and a surface layer 1203 laminated in this sequence.

The base layer 1201 shown in FIG. 5 may be any of a layer composed of thin film metal and a layer composed of heat resistant resin which maintains predetermined strength even if it receives heat from the halogen lamp 114. Polyimide resin and polyamide resin are exemplified as the heat resistant resin from a view point of strength and dimensional stability at high temperature, and the polyimide resins is more suitable when a film forming property is additionally taken into consideration. The base layer 1201 composed of the polyimide resin is manufactured using a polyimide precursor solution. Exemplified as the method of manufacturing the base layer 1201 are, for example, a centrifugal molding method of coating the polyimide precursor solution on the inner surface of a cylindrical body and drying it while rotating the cylindrical body, an inner surface coating method of spreading the polyimide precursor solution on the inner surface of a cylindrical body, and an outer surface coating method of coating a solution on the outer surface of a core body as disclosed in Japanese Patent Application Laid-Open No. 2002-91027.

A thickness of approximately 20 μm or more is necessary to the base layer 1201 from a view point of necessary strength in use (to cope with the breakage, wrinkles, and buckling of the belt), and a thickness of 200 μm or less is acceptable and a thickness of 50 μm or more to 100 μm or less is more suitable from a view point of flexibility and a thermal capacity.

When the base layer 1201 is a layer composed of the thin film metal, the thickness there of may be 150 μm or less and further may be 20 μm or more to 80 μm or less. Exemplified as the base layer 1201 composed of the thin film metal are, for example, a stainless steel belt and an endless nickel belt that is formed by electroforming. In the electroforming, after metal is precipitated to a conductive master mold (electroforming mold, casting mold) by galvanizing or electroless plating, the metal is exfoliated from the master mold and made to a product. When the master mold is composed of metal, it is subjected to a surface treatment for exfoliation, where as when it is formed of nonmetal, it is subjected to a conductive treatment for plating. According to the electroforming, the shape of the master mold can be faithfully and accurately copied, thereby a high-precision product can be obtained. The width, the inside diameter, and the like of the endless electroformed nickel belt are not particularly limited and may be appropriately determined according to the application thereof.

The heat resistant elastic layer 1202 is a layer that is more deformable than the base layer 1201 and maintains predetermined strength even if it receives heat from the halogen lamp 114 shown in FIG. 4. Silicon rubber and fluorine rubber may be used as the material of the heat resistant elastic layer 1202 from a point of view of a heat resistant property, and silicon rubber, in particular, liquid silicon rubber (LSR) may be used from a point of view of compatibility between the hardness and the repelling elasticity of a material. The thickness of the heat resistant elastic layer 1202 may be 2 mm or less and further may be 0.5 mm or less. This is because an object of using the fixing belt in place of the roll is energy saving (reduction of warm-up time), and an increase in the thickness of rubber such as silicon rubber and the like greatly deteriorates a heat efficiency because the heat conduction coefficient thereof is very poor.

The surface layer 1203 is a layer for forming the surface of the fixing belt 120 and composed of heat resistant rubber such as fluorine resin and silicon rubber. The surface layer 1203 may be a layer composed of a heat resistant material whose mold release property to both the sheet and the fixed toner image is more excellent than that of the material constituting the base layer 1201 and which maintains predetermined strength even it receives heat from the halogen lamp 114 shown in FIG. 4. Exemplified as the heat resistant material having the mold release property are polytetrafluoroethylene (PTFE), perfluoroalkylvinylether copolymer (PFA), tetrafluoroethylene/hexafluoropropylene copolymer resin (FEP), and the like. When fluorine resin is used to the surface layer 1203, the thickness thereof may be set to approximately 10 μm or more to approximately 100 μm or less and further may be set to approximately 15 μm or more to approximately 50 μm or less. This is because the thickness must beset to at least approximately 10 μm in view of wear due to sheet passing. However, the thickness may be suppressed to approximately 100 μm or less due to a problem in that a fluorine resin material used in the surface layer is expensive and that an increase in thickness of the layer requires applying the resin material twice in a coating job.

Note that a higher mold release property can be secured by providing the mold releaser application unit 340 for applying mold release oil.

Explanation will be made with reference to FIG. 4 again. The press member 130 shown in FIG. 4 includes a low friction sheet 131, an elastic member 132, a support member 133, and a frame 135.

The front surface of the low friction sheet 131 shown in FIG. 4, which is in contact with the inner peripheral surface of the fixing belt 120, is composed a low friction material that is hard and flexible and has a friction resistance smaller that of the elastic member 132. The low friction sheet 131 is formed by overlapping plural sheets in the thickness direction thereof, and the plural sheets include a heat conduction sheet composed of a heat conduction anisotropic material whose heat conduction coefficient showing the degree of easiness of heat conduction in a surface direction in which the heat conduction layer extends is larger than the heat conduction coefficient showing the degree of easiness of heat conduction in a thickness direction. The low friction sheet 131 is disposed so as to cover the elastic member 132, an end 131*a* of the fixing belt 120 upstream of the circulating direction thereof is fixed to the support member 133, and the other end 131*b* thereof is arranged as a free end. Note that the other end 131*b* may be fixed to the frame 135, or the low friction sheet 131 itself may be formed in a cylindrical shape and a part of the other end 131*b* may be fixed to the press member 130 in the state that the low friction sheet 131 covers the entire peripheral surface of the press member 130. The low friction sheet 131 will be explained later more in detail.

The elastic member 132 is accommodated in a recessed portion 1331 formed to the support member 133 so as to slightly project from the support member 133 toward the heat roll 110. A long solid sheet member, an aberrant type solid member, an aberrant type tube, a foamed rubber sheet, and the like may be used as the elastic member 132, and silicone rubber, fluorine rubber, urethane, natural rubber, SBR, IR, and the like can be exemplified as the material of the elastic member 132. Note that plural springs may be used in place of the elastic member 132 composed of the rubber material. The elastic member 132 is required to have sufficient flexibility. The hardness of the elastic member 132 that is specifically required thereto is within the range of approximately 10° to 70°, may be within the range of approximately 20° to 50°, and particularly within the range of 30° to 50° in terms of JIS-A hardness. When the hardness of the elastic member 132 is less than 10°, the rubber is excessively deformed and a nip position is made unstable, where as when it exceeds 70°, the flexibility of the elastic member 132 cannot be secured because the hardness thereof is too high. Although the thickness of the elastic member 132 is not particularly limited, it may have an average thickness within the range of approximately 2 to 6 mm and particularly within the range of approximately 3 to 5 mm. In particular, the average thickness of the portion of the support member 133 projecting from the recessed portion 1331 may be within the range of approximately 0.3 to 1.2 mm and further be within the range of approximately 0.5 to 1.0 mm.

The support member 133 is composed of a metal material such as aluminum and the like.

The frame 135 urges the overall press member 130 toward the axial center of the heat roll 110 by the load from a not shown spring, thereby the outer peripheral surface of the fixing belt 120 is supported by the press member 130 and pressed against the surface of the heat roll 110. The support member 133 has a travel guide 134 attached thereto to regulate the looseness of the fixing belt 120 in the circulating direction thereof and to permit the fixing belt 120 to circulate smoothly.

Further, the fixing device 100 shown in FIG. 4 includes a lubricant supply means 160 for supplying a lubricant to the inner peripheral surface of the fixing belt 120. The lubricant supply means 160 has a felt 161 in contact with the inner peripheral surface of the fixing belt 120. The felt 161 is impregnated with hindered amine oil as the lubricant and applies the lubricant to the inner peripheral surface of the fixing belt 120.

Further, the fixing device 100 shown in FIG. 4 includes an exfoliation means 170 disposed downstream of the nip region N in the rotating direction of the heat roll 110 to secure a higher sheet exfoliation property. In the exfoliation means 170 shown in FIG. 4, an exfoliation sheet 171 is held by a hold member 172 in the direction (reverse direction) opposite to the rotating direction of the heat roll 110 with a slight void defined between it and the surface of the heat roll 110.

The sheet P that bears the unfixed toner image T is transported to the nip region N of the fixing device 100. When the sheet P enters the nip region N and passes therethrough, heat from the halogen lamp 114 is applied to the unfixed toner image T as well as the pressure acting on the nip region N is also applied thereto, thereby the unfixed toner image T is fixed onto the sheet P.

Subsequently, the low friction sheet 131 shown in FIG. 4 will be explained.

The low friction sheet 131 is pressed against the heat roll 110 by the elastic member 132 and corresponds to an example of a so-called sheet-like member in the fixing device of the present invention. Further, the low friction sheet 131 corresponds to an embodiment of the sheet member of the present invention.

As described above, the low friction sheet 131 has a heat conduction anisotropic sheet composed of the heat conduction anisotropic material whose heat conduction coefficient is relatively high in the surface direction thereof. Graphite having a crystal structure shown in FIG. 6 is exemplified as the heat conduction anisotropic material.

Figure 6:
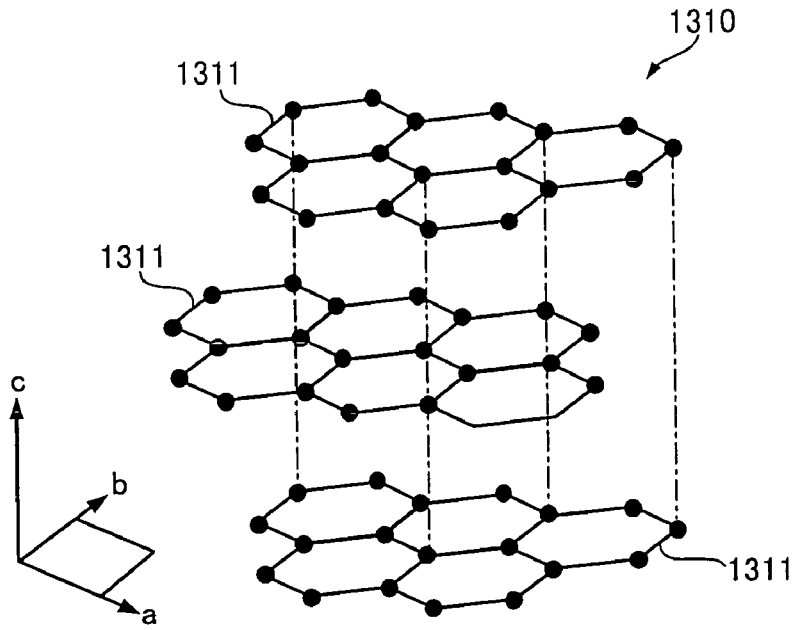
FIG. 6 is a view showing an example of a heat conduction anisotropic material used in a heat conduction layer included in the low friction sheet shown in FIG. 4.

FIG. 6 is a view showing an example of the heat conduction anisotropic material used in the heat conduction layer included in the low friction sheet shown in FIG. 4.

FIG. 6 shows graphite 1310 having a so-called graphite type crystal structure in which the condensed six-membered ring layer surfaces 1311 extend flatly on a-b surfaces and are overlapped in several layers. The a-b surface is a surface direction in which the low friction sheet 131 extends, and a c-axis direction is the thickness direction of the low friction sheet 131. The graphite 1310 shown in FIG. 6 has a high heat conduction coefficient in the direction in which the layer surfaces 1311 extend (surface direction of the a-b surface) and in the direction (c-axis direction) in which the layer surfaces 1311 are stacked. However, when the heat conduction coefficients in the respective directions are compared with each other, the heat conduction coefficient in the direction in which the layer surfaces 1311 extend is relatively higher than that in the direction in which they are stacked. This is because heat is likely to conduct in the layer surfaces 1311 having continuity, where as heat is unlike to conduct in the direction in which the layer surfaces 1311 are stacked as compared with the surface direction of the layer surfaces 1311 because the continuity existing in the layer surfaces 1311 is broken in the direction in which the layer surfaces 1311 are stacked.

However, since the graphite 1310 shown in FIG. 6 structurally has small tensile strength and small tear strength, is fragile, and has poor wear resistance, it is difficult to apply the graphite 1310 to the low friction sheet 131 which is required to be hard and flexible and to have a small coefficient of friction. Accordingly, heat resistant resin such as polyimide resin, fluorine resin, and the like or a metal thin film of stainless steel and the like is laminated or bonded onto the front surface of the low friction sheet 131 that slides on at least the inner peripheral surface of the fixing belt 120. Further, it is acceptable to cover the surface of the low friction sheet 131 on the press member 130 side serving as the back surface thereof with heat resistant resin or heat resistant rubber. The low friction sheet 131 shown in FIG. 4 is formed by sandwiching a sheet composed of the graphite 1310 shown in FIG. 6 between heat resistant resin sheets in the thickness direction thereof and bonding them with each other, and the sheet composed of the graphite 1310 corresponds to an example of the heat conduction layer in the present invention.

Figure 7:
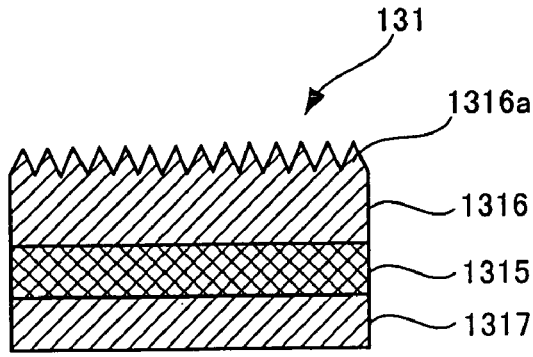
FIG. 7 is a view schematically showing the section of the low friction sheet shown in FIG. 4.

FIG. 7 is a view schematically showing the section of the low friction sheet shown in FIG. 4.

The low friction sheet 131 shown in FIG. 7 is formed by sandwiching a heat conduction anisotropic sheet 1315, which corresponds to the example of the heat conduction layer of the present invention composed of the graphite 1310 shown in FIG. 6, between polyimide resin sheets 1316 and 1317 in the thickness direction thereof. The thickness of the heat conduction anisotropic sheet 1315 is 0.1 μm. The heat conduction anisotropic sheet 1315 is a sheet whose heat conduction coefficient showing the degree of easiness of heat conduction in a surface direction in which the sheet 1315 extends is larger than the heat conduction coefficient showing the degree of easiness of heat conduction in a thickness direction.

Plural sizes of sheets are supplied to the nip region N of the fixing device 100 shown in FIG. 4 from the sheet feed tray group 80 (refer to FIG. 2), in which sheets having various sizes, for example, A3 size, B4 size, A4 size, B5 size, and the like are accommodated separately according to their sizes. Accordingly, the maximum sheet pass width of the fixing device 100 shown in FIG. 4 is set in correspondence to an A3 sheet. Thus, when a sheet having a size smaller than A3 size is passed through the nip region N, (when, for example, an A4 is passed longitudinally and when a B5 sheet is passed), both the end portions of the nip region N in the width direction thereof (direction perpendicular to the surface of the sheet showing FIG. 4) are regions through which no sheet passes (herein after, the regions are referred to as "non-sheet-pass regions"). Since the low friction sheet 131 shown in FIG. 7 is likely to conduct heat relatively in a surface direction, the heat received by the nip region N shown in FIG. 4 is likely to spread in the surface direction. Accordingly, the increase in temperature of the non-sheet-pass regions, which are not in contact with sheet P nipped in the nip region N, is greatly suppressed. Further, since the outstanding increase in temperature of the non-sheet-pass regions is suppressed by a material-based approach, a cost up can be suppressed without preventing the reduction in size and the speed-up of the fixing device.

The upper portion of the low friction sheet 131 shown in FIG. 7 is a front surface in contact with the inner peripheral surface of the fixing belt 120 shown in FIG. 4, and the lower portion thereof is a back surface in contact with the press member 130 shown in FIG. 4. The thickness of the polyimide resin sheet 1317 constituting the back surface of the low friction sheet 131 is approximately 50 μm, and the thickness of the polyimide resin sheet 1316 constituting the front surface thereof is approximately 75 μm. Any of the polyimide resin sheets 1316 and 1317 is a sheet which maintains predetermined strength even if it receives heat from the halogen lamp 114 shown in FIG. 4. Further, the polyimide resin sheet 1316 constituting the front surface has a concavo/convex portion 1316*a* having a vertical interval of approximately 20 μm. The concavo/convex portion 1316*a* is formed by applying special emboss or sanding processing. The area where the inner peripheral surface of the fixing belt 120 is in contact with the front surface of the low friction sheet 131 is reduced by forming the concavo/convex portion 1316*a*, thereby the sliding resistance between the fixing belt 120 and the low friction sheet 131 can be reduced. Further, since a lubricant can be held in the recesses, the sliding resistance between the fixing belt 120 and the low friction sheet 131 can be more securely reduced.

The thickness of the low friction sheet 131 is approximately 50 μm to 4 mm and may be approximately 80 μm to 500 μm. When the thickness is less than approximately 50 μm, sufficient strength cannot be obtained, where as when it exceeds approximately 4 mm, sufficient pressure cannot be uniformly applied to the heat roll 110.

Further, the actual hardness of the surface of the low friction sheet 131 must be higher than that of the surface of the heat roll 110 to obtain a good mold release property by deforming the elastic layer 112 of the heat roll 110 and may be 80° or more and further be 95° or more in terms of JIS-A hardness.

Further, the flexibility required to the low friction sheet 131 must be such a level as to follow the flexure of the heat roll 110 without almost reacting against it. As the physical properties, the bending elastic modulus of the low friction sheet 131 may be approximately 5 GPa or less when it is in use. However, the bending elastic modulus is not limited only to the above value and must be determined in consideration of the rigidity of the low friction sheet 131 such as the thickness, and the slits and the like of the side surface thereof, that is, in consideration of components in their entirety.

Subsequently, a fixing device, which can be used in place of the fixing device 100 shown in FIG. 4 and disposed to the image forming apparatus 1 shown in FIG. 2 will be explained. Although various fixing devices such as the fixing device 300 shown in FIG. 1 and the like can be used in place of the fixing device 100 shown in FIG. 4, a fixing device having a heat source disposed inside of an endless fixing belt will be explained here.

Figure 8:
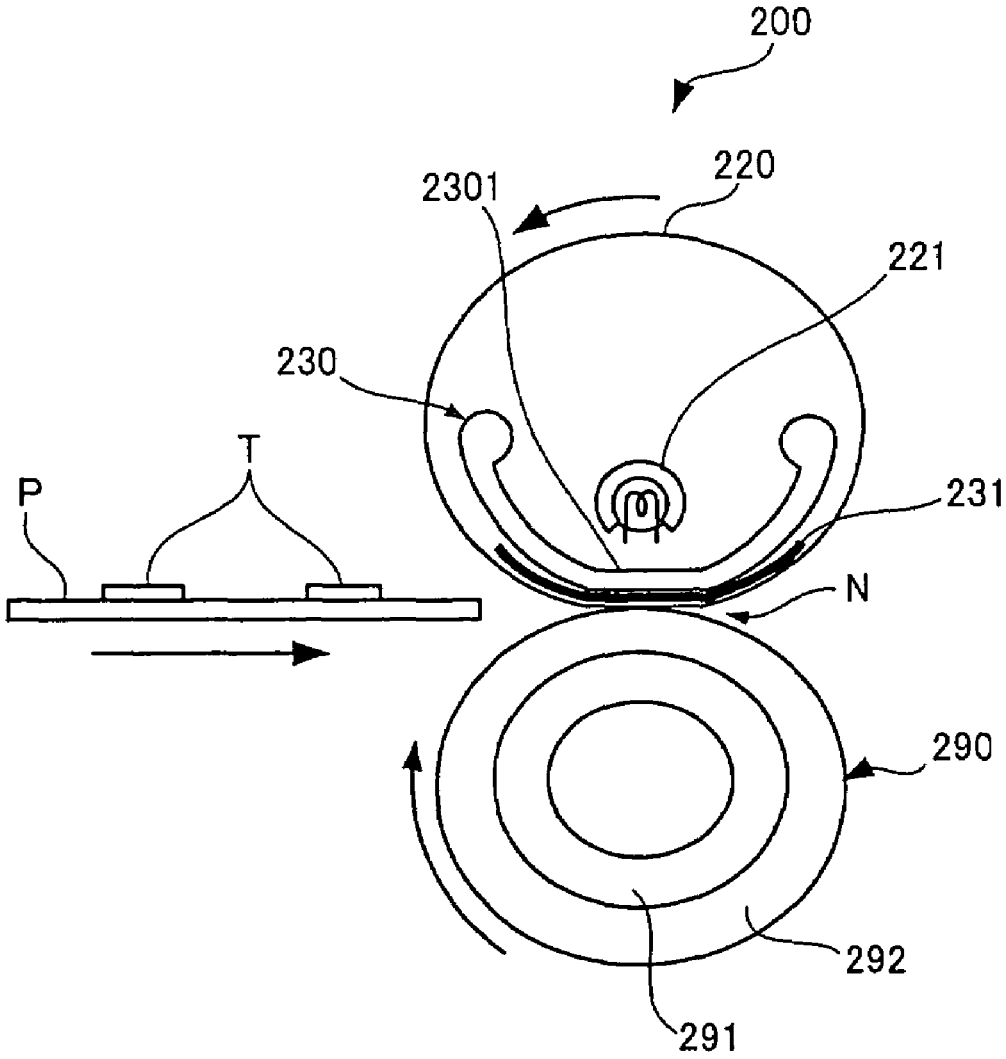
FIG. 8 is a view showing the schematic arrangement of a roll-belt type fixing device having a heat source disposed inside of an endless fixing belt.

FIG. 8 is a view showing the schematic arrangement of the roll-belt type fixing device having a heat source disposed inside of an endless fixing belt.

The fixing device 200 shown in FIG. 8 corresponds to an embodiment of the fixing device of the present invention. The fixing device 200 includes a halogen lamp 221, a presser/support member 230 having a flat surface portion 2301 and disposed so as to surround the halogen lamp 221, a fixing belt 220 disposed to surround the outer peripheral surface of the presser/support member 230, and a press roll 290 pressed against the fixing belt 220 at the position of the flat surface portion 2301 of the presser/support member 230. In the fixing device 200 shown in FIG. 8, the inner peripheral surface of the fixing belt 220 is supported by the presser/support member 230. Accordingly, when the press roll 290 is pressed against the fixing belt 220, the fixing belt 220 is relatively pressed against the press roll 290, thereby a nip region N is formed between the fixing belt 220 and the press roll 290.

The presser/support member 230 is composed of a material excellent in durability and heat resistance such as iron, aluminum, and the like and is open on the side thereof opposite to the flat surface portion 2301. The halogen lamp 221 is disposed at a position offset from the axial center of the fixing belt 220 and near to the nip region N and applies heat to an unfixed toner image T born by a sheet P passing through the nip region N from left to right in the figure. A white ceramics coated portion (heat semi-shield portion) is formed to the outside of the halogen lamp 221 opposite to the nip region N. With this arrangement, the fixing belt 220 can be directly heated by the radiant heat from the halogen lamp 221 on the opposite side of the nip region N where the presser/support member 230 is open and further can be indirectly heated by the heat conduction through the presser/support member 230. That is, the fixing belt 220 can be heated in the nip region N, in which heat is deprived therefrom, by the heat conduction from the presser/support member 230, and the fixing belt 220, from which heat is deprived in the nip region N, is heated by the radiant heat from the halogen lamp 221 at a position apart from the nip region N. Accordingly, the fixing belt 220 can be effectively heated in its entirety, and the temperatures of the fixing belt 220 and the presser/support member 230 in the nip region N can be easily and properly controlled to predetermined temperatures. Further, since the fixing belt 220 is effectively heated, a warm-up time can be reduced. The surface of the flat surface portion 2301 of the presser/support member 230 confronting the halogen lamp 221 is subjected to black color processing so that it can easily absorb the radiant heat from the halogen lamp 221.

The fixing belt 220 is composed a mold release layer and a heat absorption layer. The mold release layer is composed of a material having a thickness of about 1 to 30 μm and excellent in a mold release property and durability (for example, silicon rubber and fluorine resin). Further, the heat absorption layer is formed of polyimide resin having a thickness of 40 μm to 100 μm and mixed with 0.5 to 15 wt % of carbon black. As described above, in the fixing device 200 shown in FIG. 8, the fixing belt may include the heat absorption layer subjected to heat absorption enhancing processing so that the fixing belt 220 can easily absorb the radiant heat from the halogen lamp 221. As another example, the heat absorption layer may be formed of PFA mixed with carbon black. In this case, a fixing belt having both the mold release property and the heat absorption property can be formed even if it is arranged as a single layer structure composed of only the heat absorption layer.

The press roll 290 is a so-called soft roll composed of a metal core 291 having an elastic layer 292 formed therearound, the elastic layer 292 being composed of a highly elastic member such as heat resistant rubber, a foamed member, and the like. The press roll 290 is pressed against the fixing belt 220 by a not shown press mechanism.

The flat surface portion 2301 of the presser/support member 230 is formed in an approximately flat shape, and sufficient pressure force is applied to the fixing belt 220 by the press roll 290. Accordingly, the fixing belt 220 is circulated as well as the sheet P is transported by the rotation of the press roll 290, and the nip region N is formed approximately flat at the time, thereby the sheet P and the fixing belt 220 are transported at approximately the same transport speed (linear speed). As a result, the occurrence of wrinkles and curl of the sheet can be reduced. In the nip region N, the unfixed toner image T is fixed onto the sheet P passing therethrough under heat and pressure.

Further, in the fixing device 200 shown in FIG. 8, a low friction sheet 231 is interposed between the flat surface portion 2301 of the presser/support member 230 and the fixing belt 220 so as to cover the flat surface portion 2301 of the presser/support member 230. The low friction sheet 231 is relatively pressed against the heat roll 110 by the presser/support member 230 and corresponds to an example of a so-called sheet-like member in the fixing device of the present invention. Further, the low friction sheet 231 corresponds to an embodiment of the sheet member of the present invention.

Figure 9:
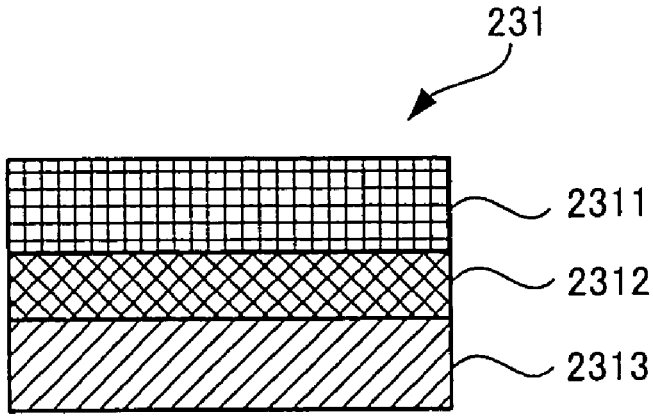
FIG. 9 is a view schematically showing the section of the low friction sheet shown in FIG. 8.

FIG. 9 is a view schematically showing the section of the low friction sheet shown in FIG. 8.

The upper portion of the low friction sheet 231 shown in FIG. 9 is a front surface in contact with the inner peripheral surface of the fixing belt 220 shown in FIG. 8, and the lower portion thereof is a back surface in contact with the flat surface portion 2301 of the presser/support member 230 shown in FIG. 8. The low friction sheet 231 shown in FIG. 9 is composed of a glass fiber sheet 2311, a polyimide resin sheet 2313, and a heat conduction anisotropic sheet 2312. The glass fiber sheet 2311 constitutes the front surface of the low friction sheet 231 in contact with the inner peripheral surface of the fixing belt 220, the polyimide resin sheet 2313 constitutes the back surface of the low friction sheet 231 in contact with the flat surface portion 2301 of the presser/support member 230, and the heat conduction anisotropic sheet 2312 is sandwiched between the glass fiber sheet 2311 and the polyimide resin sheet 2313 and composed of the graphite 1310 shown in FIG. 6. The glass fiber sheet 2311 is a sheet having a thickness of 100 μm and is composed of a glass fiber material impregnated with fluorine resin. Since the front surface of the low friction sheet 231 is composed of the glass fiber sheet 2311 as described above, the sliding resistance between the fixing belt 220 and the low friction sheet 231 is reduced by the low friction property of the fluorine resin. Further, when a lubricant is previously applied to the glass fiber sheet 2311, the sliding resistance between the fixing belt 220 and the low friction sheet 231 can be more securely reduced by the lubricant holding capability of the concavo/convex structure of the glass fiber material.

Further, the polyimide resin sheet 2313 is a 50 μm thick heat resistant sheet that maintains predetermined strength even if it receives heat from the halogen lamp 221 shown in FIG. 8. The heat conduction anisotropic sheet 2312 shown in FIG. 9 is a sheet having a relatively high heat conduction coefficient in the surface direction thereof likewise the heat conduction anisotropic sheet 1315 shown in FIG. 7 and corresponds to an example of the so-called heat conduction layer of the present invention. Accordingly, even if the fixing device 200 shown in FIG. 8 is employed, since the low friction sheet 231 shown in FIG. 9 is likely to conduct heat to the surface direction due to the material thereof, the outstanding increase in temperature of non-sheet-pass regions can be suppressed while suppressing the cost up of the fixing device without preventing the reduction in size and the speed-up thereof.

Subsequently, a low friction sheet, which has a front surface composed of a porous sheet and can be used in placed of the light receiving surfaces shown in FIGS. 7 and 9, respectively, will be explained.

Figure 10:
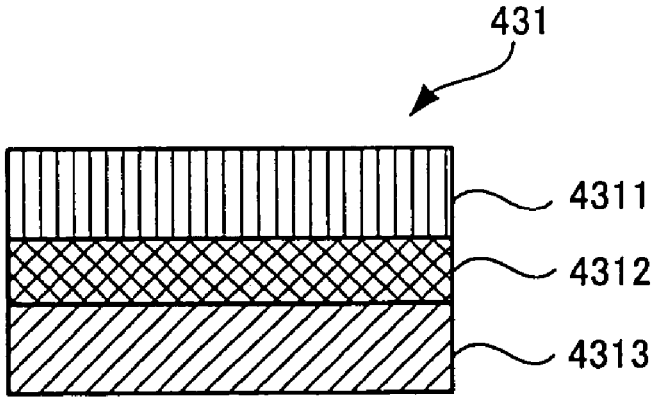
FIG. 10 is a view schematically showing the section of a low friction sheet whose front surface is composed of a porous sheet.

FIG. 10 is a view schematically showing the section of the low friction sheet whose front surface is composed of the porous sheet.

The upper portion of the low friction sheet 431 shown in FIG. 10 is a front surface in contact with the inner peripheral surface of the fixing belt, and the lower portion thereof is a back surface in contact with a support member such as the press member 130 shown in FIG. 4, the presser/support member 230 shown in FIG. 8, and the like for supporting the inner peripheral surface of the fixing belt. The low friction sheet 431 shown in FIG. 10 is composed of the porous sheet 4311, a polyimide resin sheet 4313, and a heat conduction anisotropic sheet 4312. The porous sheet 4311 constitutes the front surface of the low friction sheet 431 in contact with the inner peripheral surface of the fixing belt 220, the polyimide resin sheet 4313 constitutes the back surface of the low friction sheet 431 in contact with the support member, and the heat conduction anisotropic sheet 4312 is sandwiched between the porous sheet 4311 and the polyimide resin sheet 4313 and composed of the graphite 1310 shown in FIG. 6. The porous sheet 4311 is a sheet formed by bonding PTFE (polytetrafluoroethylene) porous resin fiber fabrics to a PTFE porous resin film. Since a lubricant is held in the pores of the porous sheet 4311 by forming it on the front surface of the low friction sheet 431, the sliding resistance between the fixing belt and the low friction sheet 431 can be more securely reduced.

Note that since the polyimide resin sheet 4313 and the heat conduction anisotropic sheet 4312 are the same as those explained up to now, the explanation thereof is omitted.

Subsequently, an example, in which the fixing belt 120 shown in FIG. 4, the fixing belt 220 shown in FIG. 8, and further the fixing belt 330 shown in FIG. 1 contain a heat conduction anisotropic sheet composed of the graphite 1310 shown in FIG. 6, will be explained as an example of a so-called planar member of the fixing device of the present invention.

As described above, since the graphite 1310 shown in FIG. 6 is fragile and has a poor wear resistant property due to the structure thereof, it is difficult to apply a heat conduction anisotropic sheet composed of the graphite 1310 to the fixing belt 220 as it is. Here, the heat conduction anisotropic sheet composed of the graphite 1310 shown in FIG. 6 is formed in a cylindrical shape and sandwiched between an endless thin film metal belt and an endless elastic belt with the ends thereof abutted against each other. The thin film metal belt is disposed on an inner peripheral surface side, and the endless belt is disposed on an outer peripheral surface side. Note that an endless heat resistant resin belt may be used in place of the thin film metal belt. Further, the endless elastic belt is covered with a fluorine resin belt and molded integrally with each other by press processing. With this arrangement, a fixing belt containing the heat conduction anisotropic sheet composed of the graphite 1310 shown in FIG. 6 can be obtained. Note that the thin film metal belt used here can be used in place of the base layer 1201 shown in FIG. 5, the elastic belt can be used in place of the heat resistant elastic layer 1202 shown in FIG. 5, and the fluorine resin belt can be used in place of the surface layer 1203 shown in FIG. 5. With this arrangement, a heat conduction anisotropic property, which permits heat to conduct more easily in a belt surface direction than in a belt thickness direction, can be given to the fixing belt, thereby the outstanding temperature increase in the non-sheet-pass regions can be suppressed while suppressing the cost up of the fixing device without preventing the reduction in size and the speed-up thereof.

EXAMPLES

The embodiment of the present invention will be specifically explained more in detail using examples. It should be noted that the present invention is by no means limited to the following examples.

Example 1

A fixing device having the same arrangement as that of the fixing device 300 shown in FIG. 1 is used. A heat roll 310 is composed of a cylindrical core 311 of aluminum alloy A5052 formed in a cylindrical shape having an outside diameter of 62 mm, an inside diameter of 55 mm, and a length of 350 mm. An elastic layer 312 is formed around the surface of the cylindrical core 311 by coveting it with silicone rubber (JIS-A rubber hardness: 33°, heat conduction coefficient: 0.42 W/m·k (measured by heat ray probe method)) to a thickness of approximately 1 mm, and a mold release layer 313 is formed around the elastic layer 312 by covering the surface thereof with fluorine rubber coated therearound to a thickness of approximately 50 μm. Further, a halogen lamp heater as a heat source having an output of 1250 W is disposed in the cylindrical core 311 of the heat roll 310. Further, a roller containing a halogen lamp heater having an output of 400 W is used as an external heat roll 350. The heat roll 310 is rotated at a speed of 260 mm/sec.

Amine-modified silicon oil having viscosity of 300 cs is used as a mold releaser applied to the surface of the heat roll 310 by a mold releaser application unit 340.

A belt composed of a polyimide film having a thickness of 75 μm, a width of 340 mm, and a peripheral length of 214 mm is used as a fixing belt 320 which is stretched by three support rolls 321, 322, and 323 with tension of approximately 5 kgf. A crown-shaped stainless steel roll having a diameter of 18 mm and containing a halogen heater lamp having an output of 350 W is used as the support roll 321 (inlet roll), in which a heater lamp is contained, of the three support rolls 321, 322, and 323. Further, a crown-shaped stainless steel roll having a diameter of approximately 23 mm is used as the support roll 323 disposed in the vicinity of a pressure application member 330. The support roll having the diameter of 23 mm is disposed so as to be in pressure contact with the surface of the heat roll 310 under the pressure of 60 kgf at the outlet of the nip region N. Further, a stainless steel roll having a diameter of 18 mm and silicon rubber coated on the surface thereof, is used as the remaining support roll 322.

Amine-modified silicon oil having viscosity of 300 cs is used also as a mold releaser applied to the inner peripheral surface of the fixing belt 320 by a lubricant application unit 360.

The heat roll 310 is pressed by a compression spring, which is not shown in FIG. 1, with a total weight of 50 kg through the fixing belt 320 using a pressure application member 330. A base plate 331 constituting the pressure application member 330 is composed of a stainless steel base plate and has a width (in the circulating direction of the fixing belt) of 20 mm, a length (in the direction perpendicular to the surface of the sheet showing FIG. 1) of 360 mm, and a thickness of 7.5 mm. Further, an elastic layer 334 is composed of silicone rubber and has rubber hardness of 20° and a thickness of 5 mm. Note that the rubber hardness of the elastic layer 344 is measured by a rubber hardness tester Model Asker C made by Kobunshi Keiki Co. Ltd. by applying a load of 300 gf thereto.

Further, a low friction sheet 335 is composed of a sheet which is formed by sandwiching a heat conduction anisotropic sheet 1315 between polyimide resin sheets 1316 and 1317 in the thickness direction and has concavo/convex portions formed on the front surface thereof as shown in FIG. 7. As the heat conduction anisotropic sheet 1315, a PGS graphite sheet (name of product: Panasonic Graphite Sheet®) Model EYGS 184610 made by Matsushita Electric Industrial Co. Ltd. is used by being cut to a necessary size. The heat conduction anisotropic sheet 1315 has a heat conduction coefficient of approximately 700 W/m·k (light alternate current heat conduction coefficient measurement method) in a surface direction and a heat conduction coefficient of approximately 10 W/m·k (cyclic heating measurement method) in a thickness direction.

The fixing device 300 arranged as described above is used, and the temperature of the heat roll 310 is controlled to 175°, the temperature of the external heat roll 350 is controlled to 190°, and the temperature of the inlet roll 321 is controlled to 120°. Then, 200 A4 sheets having a basic weight of approximately 200 gsm are continuously subjected to print and fix processing at a speed of approximately 60 sheets/min with the short sides thereof set perpendicular to a sheet transport direction, and subsequently 30 A3 sheets having a basic weight of approximately 200 gsm are caused to continuously travel. After the 200 A4 sheets are continuously processed, the temperature of the non-sheet-pass regions of the heat roll 310 is different from that the sheet pass region thereof by approximately 28° at a maximum, neither wrinkles nor faulty fixing occurs, and the sheets are curled only in an amount of approximately 15 mm or less. When the 30 A3 sheets are caused to continuously travel thereafter, no hot offset is observed in an A3 sheet region outside of an A4 size region.

Although a total of 100,000 sheets are passed under the above conditions thereafter, no exfoliation occurs between the respective layers of the heat roll 310 and the fixing belt 320, the bearings and the peripheral components of the respective rolls are not damaged, and neither the sheets are wrinkled nor images are offset by the increase of belt sliding torque.

Example 2

A fixing device having the same arrangement as that of the fixing device 100 shown in FIG. 4 is used. A heat roll 110 is composed of an aluminum cylindrical core 111 having an outside diameter of 24 mm, a wall thickness of 1.66 mm, and a length of 400 mm. An elastic layer 112 is formed around the surface of the cylindrical core 111 by coveting it with silicone rubber (JIS-A rubber hardness: 33°, heat conduction coefficient: 0.42 W/m·k (measured by heat ray probe method) to a thickness of approximately 600 μm and a length of 330 mm, and then a mold release layer 313 is formed around the surface of the elastic layer 112 by covering it with a PFA tube 313 having a thickness of approximately 30 μm. Further, a halogen lamp as a heat source of approximately 960 W (ordinarily 600 W) is disposed in the core 111 of the heat roll 110. The heat roll 110 is rotated at a speed of 192 mm/sec.

A fixing belt 120 is composed of a base layer of thermosetting polyimide having a thickness of 75 μm, a width of 344 mm, and a peripheral length of 94 mm and a heat resistant resin film formed on the outer peripheral surface of the base layer by coating it with perfluoroalkoxy fluoride resin to a thickness of 30 μm.

The heat roll 110 is pressed by a not shown compression spring with a total weight of 33 kg through the fixing belt 120 using the press member 130. At the time, a nip length is about 6 mm. An elastic member 132 constituting the press member 130 is composed of silicone rubber and has a width of 4 mm, a wall thickness of 4 mm, a length of 340 mm, and rubber hardness of 17° (Asker-C). A support member 133 is formed of aluminum alloy A6063 and has a width of 3 mm and a length of 348 mm.

The low friction sheet shown in FIG. 9, which has the glass fiber sheet on the front surface thereof, is used as the low friction sheet 131 in place of that shown in FIG. 7. The low friction sheet 131 is obtained by integrally molding by a press the glass fiber sheet 2311 having a thickness of approximately 100 μm, the polyimide resin sheet 2313 having a thickness of approximately 50 μm each shown in FIG. 9, and the heat conduction anisotropic sheet 2312 made of the graphite 1310 shown in FIG. 6 and sandwiched between the sheets 2311 and 2313. The same heat conduction anisotropic sheet as that used in the example 1 is used as the heat conduction anisotropic sheet 2312.

A lubricant supply means 160 for supplying a lubricant to the inner peripheral surface of the fixing belt 320 employs a felt 161 having a width of 10 mm, a thickness of 5 mm, and a length of 300 mm and impregnated with 2 g of hindered amine oil as a lubricant.

Note that the glass fiber sheet 2311 of the low friction sheet 131 is also impregnated with the oil previously.

The fixing device 100 arranged as described above is used, and the temperature of the heat roll 110 is controlled to 165°. Then, 200 A4 sheets having a basic weight of approximately 90 gsm are continuously subjected to print and fix processing at a speed of approximately 35 sheets/min with the short sides thereof set perpendicular to a sheet transport direction, and subsequently 30 A3 sheets having a basic weight of approximately 90 gsm are caused to continuously travel. After the 200 A4 sheets are continuously processed, the temperature of the non-sheet-pass regions of the heat roll 110 is different from that the sheet pass region thereof by approximately 33° at a maximum, neither wrinkles nor faulty fixing occurs, and the sheets are curled only in an amount of 10 mm or less during the time. Subsequently, when the 30 A3 sheets are caused to continuously travel, no hot offset is observed in an A3 sheet region outside of an A4 size region.

Thereafter, although a total of 100,000 sheets are passed under the above conditions, no exfoliation occurs between the respective layers of the heat roll 110 and the fixing belt 120, the bearing and the peripheral components of the heat roll 110 are not damaged, and neither the sheets are wrinkled nor images are offset by the increase of belt sliding torque.

Example 3

A fixing device having the same arrangement as that of the fixing device 200 shown in FIG. 8 is used.

A halogen lamp having an output of 900 W is used as a halogen lamp 221 disposed inside of a fixing belt 220. The halogen lamp is disposed at a position offset 7 mm from the axial center of a fixing belt 220 in a direction near to a nip region N.

A presser/support member 230 is disposed to surround the halogen lamp 221 at a center angle of approximately 240°. The presser/support member 230 is formed of aluminum alloy A6063. Further, the flat surface portion 231 of the presser/support member 230 has a length of about 10 mm.

Used as the fixing belt 220 is an endless belt having a thickness of 78 μm, a width of 254 mm, and a peripheral length of 94 mm. The endless belt has a heat absorption layer formed thereon by a known method, and the heat absorption layer is covered with PFA in a thickness of 30 μm as a mold release layer. The heat absorption layer is composed of polyimide resin blended with 4 wt % of carbon black (Special Black 4 (primary particle size: approximately 25 μm) made by Degussa-Huels AG).

A press roll 290 has a core 291 composed of stainless steel metal shaft having approximately ϕ12 mm. The metal core 291 constituting the press roll 290 is covered with foamed silicone rubber having a wall thickness of approximately 8 mm so that the length thereof is set to approximately 235 mm, and the outer surface of the silicone rubber is covered with a PFA tube having a thickness of about 30 μm so that the outside diameter of the press roll 290 is set to 28 mm.

Further, the low friction sheet 231 has a glass fiber sheet disposed on the front surface thereof as shown in FIG. 9 likewise the example 2. The low friction sheet 231 is obtained by integrally molding by a press the glass fiber sheet 2311 having a thickness of approximately 100 μm, the polyimide resin sheet 2313 having a thickness of approximately 40 μm each shown in FIG. 9, and the heat conduction anisotropic sheet 2312 made of the graphite 1310 shown in FIG. 6 and sandwiched between the sheets 2311 and 2313. The same heat conduction anisotropic sheet as that used in the example 1 is used as the heat conduction anisotropic sheet 2312.

The fixing device 200 arranged as described above is used, and the surface temperature of the fixing belt 220 is controlled to approximately 175° by a temperature controller (not shown) mounted on the inner peripheral surface of the fixing belt 220 in the vicinity of the presser/support member 230 on a sheet entering side. Then, 200 B5 sheets having a basic weight of approximately 90 gsm are continuously subjected to print and fix processing at a speed of approximately 30 sheets/min with the short sides thereof set perpendicular to a sheet transport direction, and subsequently 30 A4 sheets having a basic weight of approximately 90 gsm are caused to continuously travel with the short sides thereof set perpendicular to the sheet transport direction. After the 200 B5 sheets are continuously processed, the temperature of the non-sheet-pass regions of the fixing belt 220 is different from that the sheet pass region thereof by approximately 35° C. at a maximum, neither wrinkles nor faulty fixing occurs, and the sheets are curled only in an amount of approximately 15 mm or less during the time. Subsequently, when the 30 A4 sheets are caused to continuously travel, no hot offset is observed in an A4 sheet region outside of a B5 size region.

Thereafter, although a total of 100,000 sheets are passed under the above conditions, no exfoliation occurs between the respective layers of the press roll 290 and the fixing belt 220, the bearings and the peripheral components of the press roll 290 are not damaged, and neither the sheets are wrinkled nor images are offset by the increase of belt sliding torque.

Example 4

An example 4 is arranged and set similarly to the example 2 except that the low friction sheet 131 covering the elastic member 132 of the press member 130 shown in FIG. 4 is replaced with a low friction sheet having a porous sheet disposed on the front surface thereof shown in FIG. 4.

A fixing device 100 arranged as described above is used, the temperature of a heat roll 110 is controlled to 165° C., 200 A4 sheets having a basic weight of approximately 90 gsm are continuously subjected to print and fix processing at a speed of approximately 35 sheets/min with the short sides thereof set perpendicular to a sheet transport direction, and subsequently 30 A3 sheets having a basic weight of approximately 90 gsm are caused to continuously travel. After the 200 A4 sheets are continuously processed, the temperature of the non-sheet-pass regions of the heat roll 110 is different from that the sheet pass region thereof by approximately 33° C. at a maximum, neither wrinkles nor faulty fixing occurs, and the sheets are curled only in an amount of approximately 15 mm or less during the time. Subsequently, when the 30 A3 sheets are caused to continuously travel, no hot offset is observed in an A3 sheet region outside of an A4 size region.

Thereafter, although a total of 100,000 sheets are passed under the above conditions, no exfoliation occurs between the respective layers of the heat roll 110 and a fixing belt 120, the bearings and the peripheral components of the heat roll 110 are not damaged, and neither the sheets are wrinkled nor images are offset by the increase of belt sliding torque.

Comparative Example 1

A comparative example 1 is arranged and set similarly to the example 1 except that the low friction sheet 335 covering the entire periphery of the pressure application member 330 shown in FIG. 1 is replaced with a single layer sheet formed of a polyimide resin sheet having a thickness of 75 μm on the surface of which concavo/convex portions are formed by embossing. That is, the comparative example 1 employs a low friction sheet which does not include a heat conduction anisotropic sheet.

A fixing device 300 arranged as described above is used, the temperature of a heat roll 310 is controlled to 175° C., the temperature of an external heat roll 350 is controlled to 190°, and the temperature of an inlet roll 321 is controlled to 120° C. Then, 200 A4 sheets having a basic weight of approximately 20 gsm are continuously subjected to print and fix processing at a speed of approximately 60 sheets/min with the short sides thereof set perpendicular to a sheet transport direction, and subsequently 30 A3 sheets having a basic weight of approximately 200 gsm are caused to continuously travel. After the 200 A4 sheets are continuously processed, the temperature of the non-sheet-pass regions of the heat roll 310 is different from that the sheet pass region thereof by approximately 41° at a maximum, and approximately 2% of the sheets is wrinkled and the sheets are curled in approximately 33 mm at a maximum during the time. Further, when the 30 A3 sheets are caused to continuously travel, hot offset occurs in the first to eighth sheets of the 30 sheets in an A3 sheet region outside of an A4 size region.

Thereafter, when 40,000 sheets are passed under the above conditions, the metal core 311 of the heat roll 310 is exfoliated from the elastic layer 312, belt slide torque is increased by the damage of the bearings of the respective rolls and the thermal deterioration of a lubricant, thereby sheets are wrinkled and images are offset.

Comparative Example 2

A comparative example 2 is arranged and set similarly to the example 2 except that the low friction sheet 131 covering the elastic member 132 of the press member 130 shown in FIG. 4 is replaced with a single layer sheet composed of a porous material formed by bonding a PTFE (polytetrafluoroethylene) porous resin fiber fabrics to a PTFE porous resin film. That is, the comparative example 2 also employs a low friction sheet which does not include a heat conduction anisotropic sheet.

A fixing device 100 arranged as described above is used, the temperature of a heat roll 110 is controlled to 165° C., 200 A4 sheets having a basic weight of approximately 90 gsm are continuously subjected to print and fix processing at a speed of approximately 35 sheets/min with the short sides thereof set perpendicular to a sheet transport direction, and subsequently 30 A3 sheets having a basic weight of approximately 90 gsm are caused to continuously travel. After the 200 A4 sheets are continuously processed, the temperature of the non-sheet-pass regions of the heat roll 110 is different from that the sheet pass region thereof by approximately 45° at a maximum, and approximately 5% of the sheets is wrinkled and the sheets are curled in approximately 30 mm at a maximum during the processing. Subsequently, when the 30 A3 sheets are caused to continuously travel, hot offset occurs in the 10 sheets from the first sheet in an A3 sheet region outside of an A4 size region.

Thereafter, when 30,000 sheets are passed under the above conditions, the metal core 111 of the heat roll 110 is exfoliated from the elastic layer 112 thereof, belt slide torque is increased by the damage of the bearings of the heat roll 110 and the thermal deterioration of a lubricant, thereby sheets are wrinkled and images are offset.

Comparative Example 3

A comparative example 3 is arranged and set similarly to the example 3 except that the low friction sheet 231 that covers the flat surface portion 2301 of the presser/support member 230 shown in FIG. 8 is replaced with a 150 μm thick single layer sheet which is composed of a glass fiber material and whose front surface in contact with the inner peripheral surface of a fixing belt 220 is impregnated with fluorine resin. That is, the comparative example 3 also employs a low friction sheet which does not include a heat conduction anisotropic sheet.

A fixing device 200 arranged as described above is used, and the surface temperature of a fixing belt 220 is controlled to approximately 175° C. by a temperature controller (not shown) mounted on the inner peripheral surface of the fixing belt 220 in the vicinity of a presser/support member 230 on a sheet entering side. Then, 200 B5 sheets having a basic weight of approximately 90 gsm are continuously subjected to print and fix processing at a speed of approximately 30 sheets/min with the short sides thereof set perpendicular to a sheet transport direction, and subsequently 30 A4 sheets having a basic weight of approximately 90 gsm are caused to continuously travel with the short sides thereof set perpendicular to the sheet transport direction. After the 200 B5 sheets are continuously processed, the temperature of the non-sheet-pass regions of the fixing belt 220 is different from that the sheet pass region thereof by approximately 65° C. at a maximum, and approximately 30% of the sheets is wrinkled and the sheets are curled in an amount of approximately 50 mm at a maximum during the time. When the 30 A4 sheets are caused to continuously travel, hot offset occurs in the 20 sheets from the first sheet in an A4 sheet region outside of a B5 size region.

Thereafter, when 8,000 sheets are passed under the above conditions, belt slide torque is increased by the damage of the bearings of a press roll 290 and the thermal deterioration of a lubricant, thereby sheets are wrinkled, images are offset, and the metal core 291 of the press roll 290 is exfoliated from the elastic layer 292 thereof.

From the results described above, it can be found that an outstanding increase of temperature in the non-sheet-pass regions can be suppressed by using the low friction sheet having the heat conduction anisotropic sheet.

The foregoing description of the embodiment of the present invention has been provided for the purposes of illustration and description. It is not intended to be exhaustive or to limit the invention to the precise forms disclosed. Obviously, many modifications and variations will be apparent to practitioners skilled in the art. The embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-084017 filed on Mar. 23, 2005 including specification, claims, drawings and abstract is incorporated herein by reference in its entirety.

What is claimed is:

1. A fixing device that has a planar member including a heat conduction layer, the heat conduction layer having a predetermined thickness and relatively pressed against a rotary member being rotated so that the fixing device fixes an unfixed toner image born by a recording sheet onto the recording sheet by causing the recording sheet that bears the unfixed toner image to pass between the planar member and the rotary member and applying heat and pressure to the unfixed toner image, the fixing device comprising:

an endless belt whose outer peripheral surface is relatively pressed against the rotary member and which circulates while forming a nip region between the outer peripheral surface and the rotary member to nip the recording sheet in the nip region;

a heater that applies heat to the unfixed toner image born by the recording sheet passing between the planar member and rotary member; and a support member disposed to a back surface of the planar member to support the planar member from the back surface, wherein the planar member is a sheet member whose front surface is in contact with an inner peripheral surface of the endless belt and whose back surface is in contact with the support member, and the heat conduction layer includes a heat conduction anisotropic material whose heat conduction coefficient indicating a degree of easiness of heat conduction in a surface direction in which the heat conduction layer extends is larger than a heat conduction coefficient thereof indicating a degree of easiness of heat conduction in a thickness direction.

2. The fixing device according to claim 1, wherein the rotary member is a roll-shaped member or a belt-shaped member.

3. The fixing device according to claim 1, wherein the heat conduction layer of the planar member is sandwiched in a thickness direction between heat resistant material layers composed of a heat resistant material which maintains predetermined strength even if the heat resistant material receives heat from the heater.

4. The fixing device according to claim 3, wherein the heat resistant material layers are composed of any of a resin material and a metal material.

5. The fixing device according to claim 1, wherein the heat conduction layer has a heat conduction coefficient indicating the degree of easiness of heat conduction in the surface direction is higher than a heat conduction coefficient indicating a degree of easiness of heat conduction in the surface direction of the planar member.

6. The fixing device according to claim 1, wherein the endless belt has a composite layer structure including at least a base layer, which constitutes the inner peripheral surface, and a front surface layer which constitutes the outer peripheral surface.

7. The fixing device according to claim 6, wherein the endless belt includes a heat resistant elastic layer between the base layer and the surface layer, and wherein the heat resistant elastic layer is more likely to be elastically deformed than the base layer and maintains predetermined strength even if the heat resistant elastic layer receives heat from the heater.

8. The fixing device according to claim 1, further comprising a lubricant supply section that supplies a lubricant to the inner peripheral surface of the endless belt.

9. The fixing device according to claim 1, wherein the planar member has concavo/convex portions formed on the front surface thereof in contact with the inner peripheral surface of the endless belt.

10. The fixing device according to claim 1, wherein the front surface of the sheet member in contact with the inner peripheral surface of the endless belt is composed of a glass fiber material impregnated with fluorine resin.

11. The fixing device according to claim 1, wherein the front surface of the sheet member, which is in contact with the inner peripheral surface of the endless belt is composed of a heat resistant porous resin material which maintains predetermined strength even if the heat resistant porous resin material receives heat from the heater.

12. The fixing device according to claim 1, wherein the heat conduction anisotropic material is composed of graphite.

13. A sheet member disposed to a fixing device, the fixing device having a rotary member being rotated, an endless belt whose outer peripheral surface is relatively pressed against the rotary member and forms a nip region between the outer peripheral surface and the rotary member to nip a recording sheet in the nip region, a heater that applies heat to an unfixed toner image born by the recording sheet pinched in the nip region, and a support member disposed to an inner peripheral surface of the endless belt to support the outer peripheral surface of the endless belt from the inner peripheral surface and to apply relative press force to the nip region, and a sheet member having friction resistance smaller than that of the support member with a front surface of the sheet member in contact with the inner peripheral surface of the endless belt and a back surface of the sheet member in contact with the support member, the sheet member comprising:

a heat conduction layer that includes a heat conduction anisotropic material whose heat conduction coefficient indicating a degree of easiness of heat conduction in a surface direction in which the heat conduction layer extends is larger than a heat conduction coefficient thereof indicating a degree of easiness of heat conduction in a thickness direction.

14. The sheet member according to claim 13, wherein the heat conduction anisotropic material is composed of graphite.

15. An image forming apparatus that forms an image on a recording sheet by transferring a toner image formed on a toner image bearing member on which a toner image is formed and fixes an unfixed toner image onto the recording sheet, the image forming apparatus comprising:

a fixing device having a planar member that includes a heat conduction layer, the heat conduction layer having a predetermined thickness and relatively pressed against a rotary member being rotated to fix the unfixed toner image born by the recording sheet thereon by causing the recording sheet that bears the unfixed toner image to pass between the planar member and the rotary member and applying heat and pressure to the unfixed toner image; and an endless belt whose outer peripheral surface is relatively pressed against the rotary member and which circulates while forming a nip region between the outer peripheral surface and the rotary member to nip the recording sheet in the nip region, wherein the planar member is a sheet member whose front surface is in contact with an inner peripheral surface of the endless belt and whose back surface is in contact with a support member, wherein the fixing device includes a heater that applies heat to the unfixed toner image born by the recording sheet passing between the planar member and rotary member, and wherein the heat conduction layer includes a heat conduction anisotropic material whose heat conduction coefficient showing the degree of easiness of heat conduction in a surface direction in which the heat conduction layer extends is larger than a heat conduction coefficient thereof showing the degree of easiness of heat conduction in a thickness direction.

16. The image forming apparatus according to claim 15, wherein the heat conduction anisotropic material is composed of graphite.

* * * * *